US005408748A

United States Patent [19]

Vermillion, Jr. et al.

[11] Patent Number: 5,408,748

[45] Date of Patent: Apr. 25, 1995

[54] METHOD OF MAKING DOOR FRAMES

[75] Inventors: Howard R. Vermillion, Jr., Northridge; Lloyd M. Van Zutphen, Tujunga, both of Calif.

[73] Assignee: Valley Engravers, Inc., Burbank, Calif.

[21] Appl. No.: 308,685

[22] Filed: Sep. 19, 1994

[51] Int. Cl.[6] ..... B23P 17/00

[52] U.S. Cl. ..... 29/897.312; 29/403.1; 29/412

[58] Field of Search ..... 29/897.312, 403.1, 412; 52/204.1; 49/504; 83/13

[56] References Cited

U.S. PATENT DOCUMENTS 5,361,476 11/1994 Leopold ..... 29/412

*Primary Examiner*—David P. Bryant

*Attorney, Agent, or Firm*—Jack C. Munro

[57] ABSTRACT

The method of making a plurality of door frames from a single slab of metallic sheet material. The largest size door frame is first produced from a slab of material separating such from this slab of material. Then producing a second size of door frame from the remaining section of the slab of material where the second size is of a smaller configuration than the first size. Both door frames are each a single integral unit. There may be produced a third size of door frame from the remaining slab of material and possibly even a fourth size.

8 Claims, 1 Drawing Sheet

METHOD OF MAKING DOOR FRAMES

BACKGROUND OF THE INVENTION

1) Field of the Invention

The field of this invention relates to a method of making border structural members and more particularly to a method of making a plurality of door frames from a single slab of sheet metal.

22) Description of Prior Art

A door frame comprises a part which is utilized as a perimeter structural frame for door assemblies. These frames can be manufactured from many machineable metals such as aluminum, steel and the like. It is even possible to construct the door frame from other than a metallic material such as a hard plastic.

Traditionally, door frames have been manufactured by utilizing a variety of extruded materials, cut to appropriate lengths, with the corner joints mitred and then assembled by utilizing adhesive mechanical fasteners such as rivets, welding and the like. These door frames, because they are not integral, are inherently weak and typically have sharp corners and edges.

A use for a great number of door frames is within aircraft. Within airlines, the normally abusive operational practices of the cabin service personnel cause these frames, that have been assembled in this manner, to bend, twist, crack and finally break, with the corners that have been mitred separating and breaking, creating even sharper edges. These doors within aircraft have become a maintenance headache as well as a safety hazard. It has been discovered that if a solid integral door frame could be manufactured and used in lieu of the door frames that have been constructed of a plurality of assembled parts, that maintenance of such door frames and the safety problems that have been associated with such door frames in the past, are now eliminated. Also, a door frame has been produced that is aesthetically superior.

SUMMARY OF THE INVENTION

The method of the present invention of manufacturing door frames is to start with a solid slab of material. The largest size of door frame is cut out of the slab using one or more of a combination of various machining techniques. A smaller size door frame is then manufactured from the remaining slab of material that is the remnant from the center of the largest door frame. This procedure can be continued producing still further smaller size door frames for best utilization of the slab of material.

One of the objectives of the present invention is to utilize a method of manufacturing solid integral door frames ecomomically for cost effectiveness in today's manufacturing climate.

DETAILED DESCRIPTION OF THE INVENTION

Figure 1:
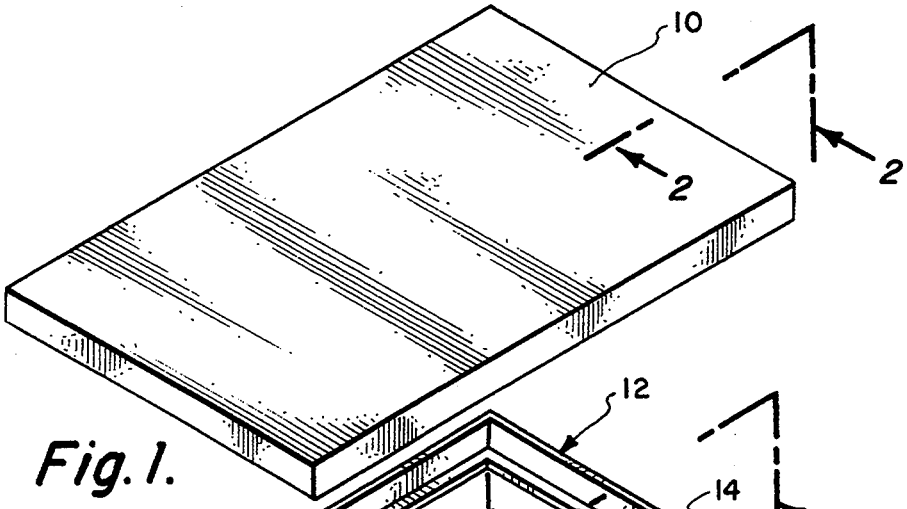
FIG. 1 is an isometric view of a slab of metallic material from which is to be produced the door frames by the method of the present invention.
Figure 3:
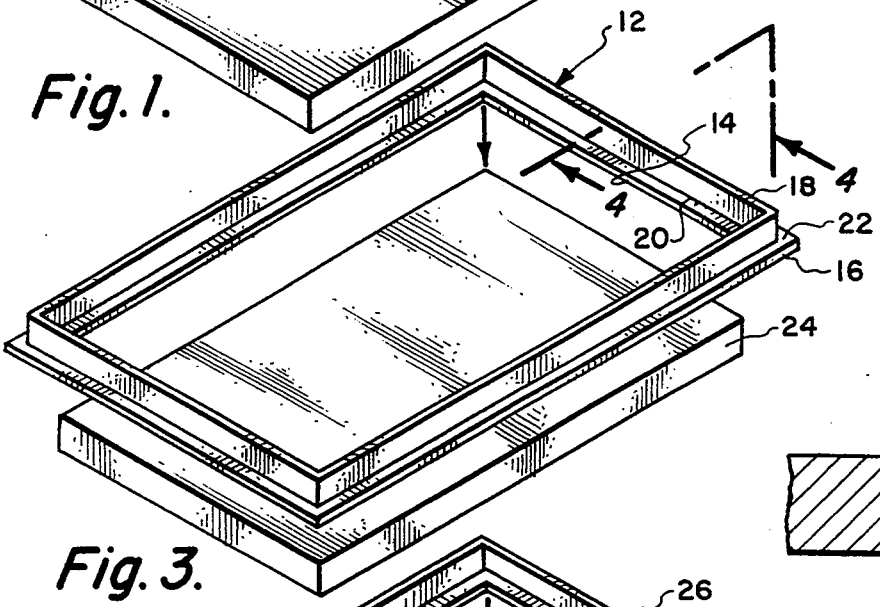
FIG. 3 is an isometric view depicting producing of the largest size of door frame from the slab of material and showing the largest size of door frame being separated from the remaining portion of the slab.
Figure 2:
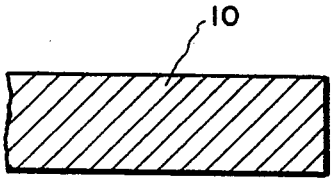
FIG. 2 is a cross sectional view taken along line 2—2 of FIG. 1.
Figure 5:
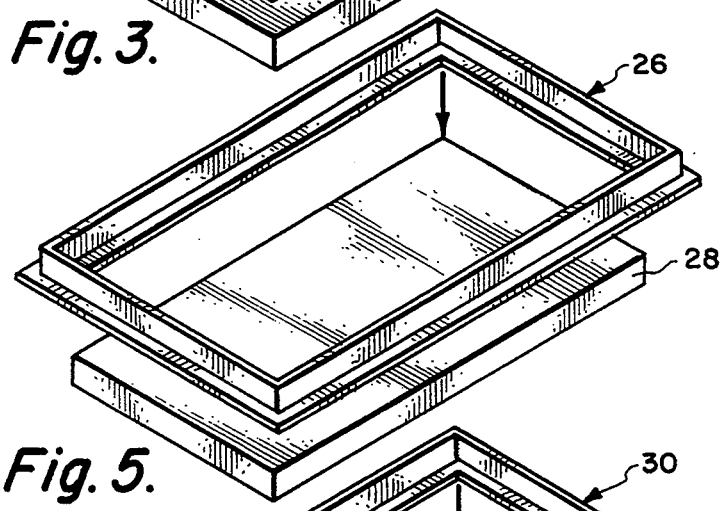
FIG. 5 is an isometric view showing producing of a smaller sized door frame from the remaining portion of the slab of material with this smaller size frame being separated from the slab.
Figure 4:
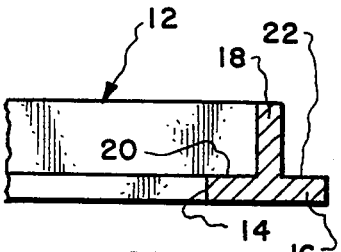
FIG. 4 is a cross sectional view taken along line 4—4 of FIG. 3.
Figure 6:
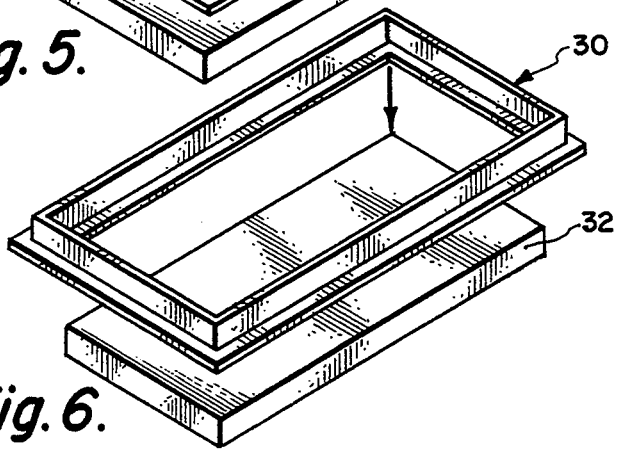
FIG. 6 is an isometric view showing a still further manufacture of a door frame of a yet smaller size from the slab of material.

Referring particularly to the drawing, there is shown a slab 10 of metal with generally aluminum to be preferred. The largest size door frame 12 is to be machined from the periphery of the slab 10 in its final configuration. A typical configuration would be the T-shaped configuration comprising a base 16 and upstanding flange 18 forming inner ledge 20 and outer ledge 22. A desirable machining technique to produce the door frame 12 would be machining with an end mill. However, other machining techniques such as electro discharge machining, laser cutting, plasma cutting, chemical milling, conventional machining with a tool bit, saws and stamping could also be employed.

Once the final configuration of the door frame 12 has been achieved, the door frame 12 is then severed from the slab 10 at edge 14. It is important that the door frame 12 remain attached to the slab 10 with this severing occurring as a final step. As long as the door frame 12 is attached to the slab 10 in essence the slab 10 provides a work table type surface to achieve the machining operations to produce the door frame 12. Once the door frame 12 has been severed along edge 14, it is then removed from the slab 10 producing a remnant slab 24.

The operator then takes the remnant slab 24 and again duplicates the process of producing a second door frame 26. The door frame 26 can be of the same configuration as door frame 12 or could be of a different configuration. Also it is to be understood that the door frame 12 could be of any numerous types of configurations with only the configuration being shown as being representative. Again, once the door frame 26 has been completely formed, it is then severed as a final step and removed from the slab 24 producing a remnant slab 28.

Again a further door frame 30 will be formed from the remnant slab 28 in the same manner as previously discussed. As a final step, the severing occurs along the edge 14 to remove the door frame 30 producing a remnant slab 32. A further smaller size door frame may be produced from the remnant slab 32 if the remnant slab 32 is of sufficient size. If remnant slab 32 is not of sufficient size, it is then to be discarded. It is to be understood that the door frame 30 is of a smaller size than door frame 12 which is of a larger size. Door frame 26 is of a size in between door frames 12 and 30.

What is claimed is:

1. A method of making door frames comprising:

providing a slab of metallic sheet material;

producing a first door frame of a first size from said slab where said first door frame is a single integral unit;

producing a second door frame of a second size from said slab where said second door frame is a single integral unit and where said second size is smaller than said first size.

2. The method as defined in claim 1, further comprising:

producing a third door frame of a third size from said slab where said third door frame is a single integral unit and where said third size is smaller than said second size.

3. A method of making border structural members, each border structural member enclosing an open area, said method comprising:

providing a slab of metallic sheet material;

producing a first structural member of a first size from said slab where said first structural member is a single integral unit;

producing a second structural member of a second size from said slab where said second structural member is a single integral unit and where said second size is smaller than said first size.

4. The method as defined in claim 3, further comprising:

producing a structural member of a third size from said slab where said third structural member is a single integral unit and where said third size is smaller than said second size.

5. A method of making door frames comprising:

providing a slab of rigid sheet material which has a first free peripheral edge;

forming a first door frame of a first size from said slab at said first peripheral edge;

severing said first door frame from said slab to achieve a single integral unit for said first door frame while leaving a first remnant slab with a second free peripheral edge;

forming a door frame of a second size from said first remnant slab at said second free peripheral edge; and severing said second door frame from said first remnant slab to achieve a single integral unit for said second door frame while leaving a second remnant slab with a third free peripheral edge.

6. The method as defined in claim 5, further comprising:

forming a third door frame of a third size from said second remnant slab at said third free peripheral edge; and severing said third door frame from said second remnant slab to achieve a single integral unit for said third door frame.

7. A method of making border structural members, each border structural member enclosing an open area, said method comprising:

providing a slab of rigid sheet material which has a first free peripheral edge;

forming a first structural member of a first size from said slab at said first peripheral edge;

severing said first structural member from said slab to achieve a single integral unit for said first structural member while leaving a first remnant slab with a second free peripheral edge;

forming a second structural member of a second size from said first remnant slab at said second free peripheral edge; and severing said second structural member from said first remnant slab to achieve a single integral unit for said second structural member while leaving a second remnant slab with a third free peripheral edge.

8. The method as defined in claim 7, further comprising:

forming a third structural member of a third size from said second remnant slab at said third free peripheral edge; and severing said third structural member from said second remnant slab to achieve a single integral unit for said third structural member.

* * * * *